United States Patent [19]

Matsuo

[11] 4,236,708

[45] Dec. 2, 1980

[54] PNEUMATIC SHEET FEEDING APPARATUS

[76] Inventor: Masaharu Matsuo, No. 17-3, Higashi Komagata 3-chome, Sumida-ku, Tokyo, Japan

[21] Appl. No.: 10,538

[22] Filed: Feb. 9, 1979

[30] Foreign Application Priority Data

Feb. 27, 1978 [JP] Japan ..... 53/20890

[51] Int. Cl.[3] ..... B65H 3/12; B65H 7/16

[52] U.S. Cl. ..... 271/12; 271/95; 271/99

[58] Field of Search ..... 271/95, 99, 104, 11, 271/12, 35

[56] References Cited

U.S. PATENT DOCUMENTS

| | | | |
|---|---|---|---|
| 3,664,660 | 5/1972 | Runzi | 271/35 |
| 3,815,900 | 6/1974 | Schulze | 271/118 |
| 3,907,278 | 8/1975 | Jaton | 271/35 |
| 3,941,372 | 3/1976 | Matsuo | 271/95 |

*Primary Examiner*—Joseph F. Valenza

*Assistant Examiner*—Brian Bond

*Attorney, Agent, or Firm*—Toren, McGeady and Stanger

[57] ABSTRACT

Apparatus for feeding individual cardboard sheets to a rotary die cutting machine has two conveyor systems. The first system conveys a sheet from the bottom of a stack to a gap in a gate which passes only one sheet, and the second system conveys the sheet from the gap to the machine. Each system includes a perforated belt traveling in a closed loop over a suction box near the gate. The belt of the first system is shifted cyclically between an operative position of simultaneous engagement with the associated suction box and the bottom sheet of the stack and a retracted position and is accelerated and decelerated between a minimum speed in the retracted position and a maximum speed in the operative position, air being drawn from its suction box only in the operative belt position. The belt of the second system is driven continuously at a speed approximately equal to the maximum speed of the other belt, and air is drawn from its suction box only when the first belt is in the retracted position.

7 Claims, 5 Drawing Figures

FIG. I

PNEUMATIC SHEET FEEDING APPARATUS

This invention relates to apparatus for feeding individual sheets of cardboard and like material to a processing machine, such as a rotary die cutter, and particularly to an improvement over the pneumatic feeding apparatus of my earlier U.S. Pat. No. 3,941,372.

In the earlier apparatus, a continuously moving, perforated belt conveys successive lowermost sheets of a stack through a gate passing only one sheet, and the sheets are spaced on the belt by alternatingly evacuating and venting a suction box separated from the stack by the belt and by raising and lowering the portion of the belt traveling over the box. A sheet is entrained by the belt and carried through the gate only when the suction box is evacuated, and the belt otherwise travels idly. Another suction box on the other side of the belt keeps the sheet engaged with the belt while it travels away from the gate.

While the known apparatus has been used successfully in many instances, it is somewhat limited in the type of sheets that can be withdrawn individually from a stack and discharged in spaced relationship. The belt travels at its full, constant speed when engaging the stationary lowermost sheet in the stack. The strength of the sheet determines the highest permissible belt speed at which the sheet will not be damaged by frictional engagement with the belt. The belt speed, in turn, may limit the output of a processing machine supplied by the feeding apparatus to less than the machine would otherwise be capable of.

It is a primary object of this invention to modify the known feeding apparatus in such a manner that the speed at which sheets are fed to a tandem-connected processing machine is independent from the speed at which the sheets are withdrawn from a stack so that sheets of low mechanical strength may be fed to a processing machine at the highest rate at which the machine can process them.

With this and other objects in view, as will hereinafter become apparent, the invention provides a gate arrangement which bounds a receptacle space in a certain direction, the space being adapted to hold a stack of sheets, and the gate arrangement defining a gap which limits the number of sheets capable of being withdrawn simultaneously from the space. A first conveyor system conveys the lowermost sheet from the space toward the gap in the afore-mentioned direction. It includes a first suction box offset from the receptacle space in a direction transverse to the direction of sheet movement. A first perforated belt is guided on the supporting structure of the feeding apparatus in a closed loop in such a manner that a portion of the belt is interposed between the receptacle space and the suction box. A shifting device cyclically shifts the interposed belt portion between an operative position of simultaneous engagement with the sheet to be conveyed and the suction box and a retracted position downwardly offset from the operative position. A drive mechanism cyclically accelerates and decelerates the belt in its loop between a minimum speed reached when the interposed belt portion is in the retracted position and a maximum speed reached when the belt portion is in the operative position, the belt portion being moved by the drive mechanism in the desired direction of sheet movement. A second conveyor system which conveys the sheet further from the gate arrangement includes a second suction box and a second perforated belt guided on the supporting structure in a closed loop. A portion of the second belt extends away from the gate arrangement in engagement with the associated suction box. The second belt is driven continuously at a speed closely similar or equal to the maximum speed of the first belt, and the associated suction box is evacuated cyclically whenever the belt of the first conveyor system is being shifted from the operative to the retracted position.

Other features, additional objects, and many of the attendant advantages of this invention will readily be appreciated as the same becomes better understood by reference to the following detailed description of a preferred embodiment and a modification of the same when considered in connection with the appended drawing in which.

Figure 1:
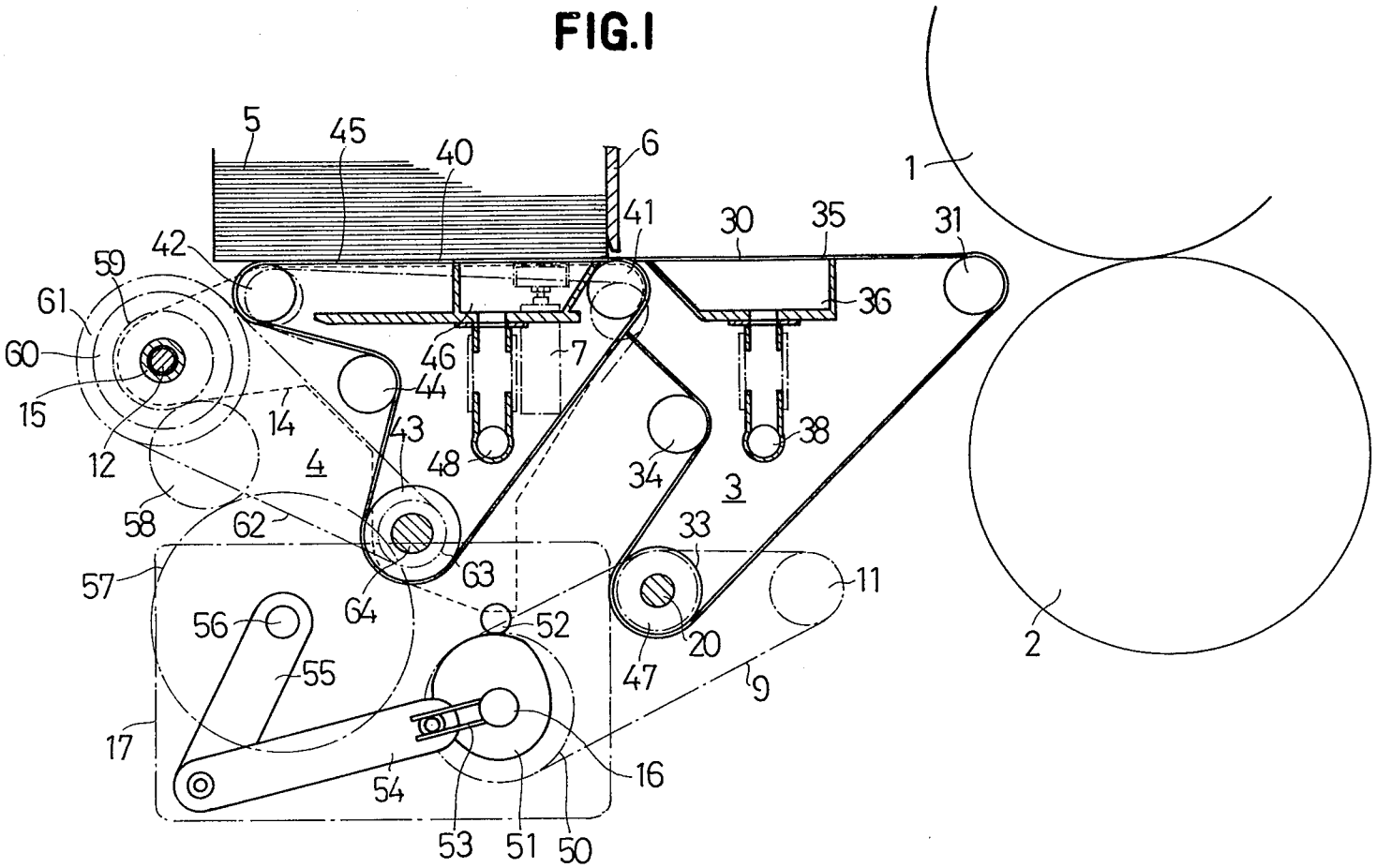
FIG. 1 shows the principal operating elements of a pneumatic sheet feeding apparatus of the invention in simplified side elevation and partly in section.
Figure 3:
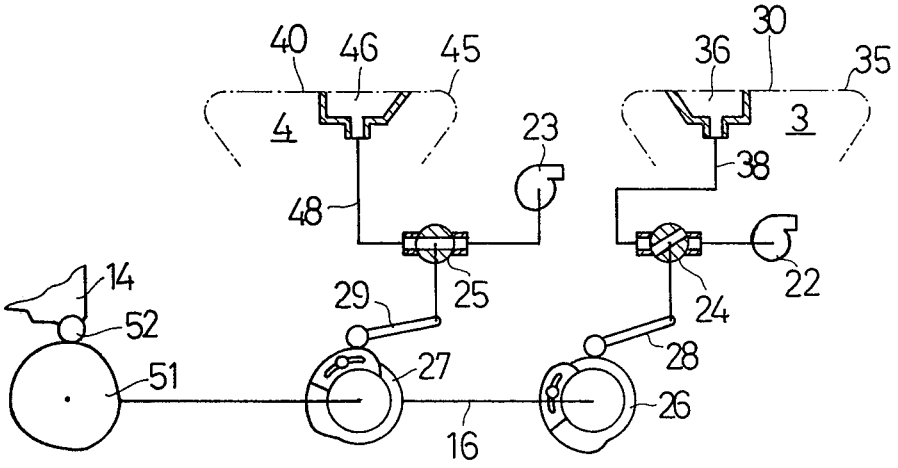
FIG. 3 is a schematic of the suction circuits in the apparatus of FIG. 1.
Figure 4:
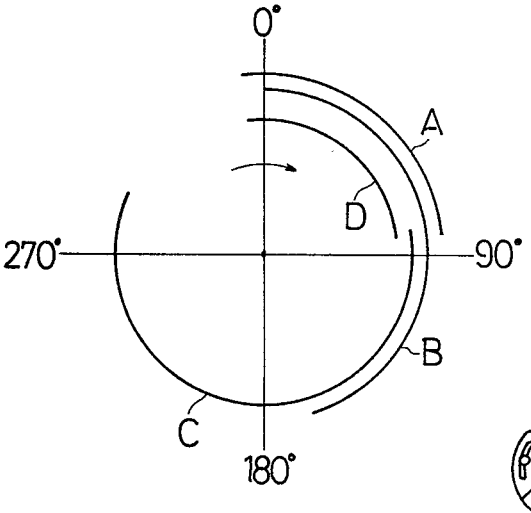
Figure 5:
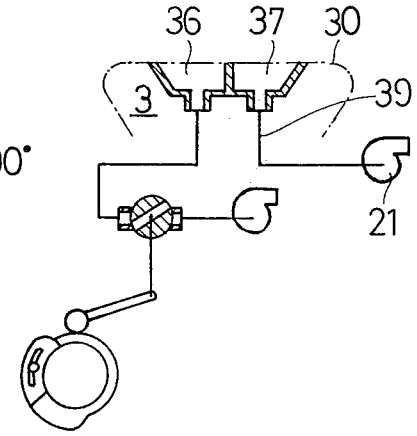

FIG. 4 diagrammatically illustrates the timing of operating elements in the apparatus of FIG. 1 during each cycle; and FIG. 5 shows a partly modified suction system for the apparatus of FIG. 1 in the manner of FIG. 3.

Referring now to the drawing, and initially to FIG. 1, there are shown two cylinders 1, 2 representing cooperating cutting tools of a rotary die cutting machine, not itself part of this invention and not shown in detail. Stacked sheets 5 of cardboard are fed individually from a receptacle space through a gap bounded by a gate 6 by a delivery conveyor system 3 backed by a primary conveyor system 4. The gate 6 and associated sheet confining elements have been more fully described in my earlier patent, and the gate 6 is shown in FIG. 1 only to the extent needed for an understanding of its effect on limiting the number of sheets 5 that may be withdrawn by the conveyor system 4 from the receptacle space bounded by the gate 6 in the direction of sheet movement toward the nip of the cylinders 1, 2. The space is defined downwardly by a row of pneumatic jacks 7.

Figure 2:
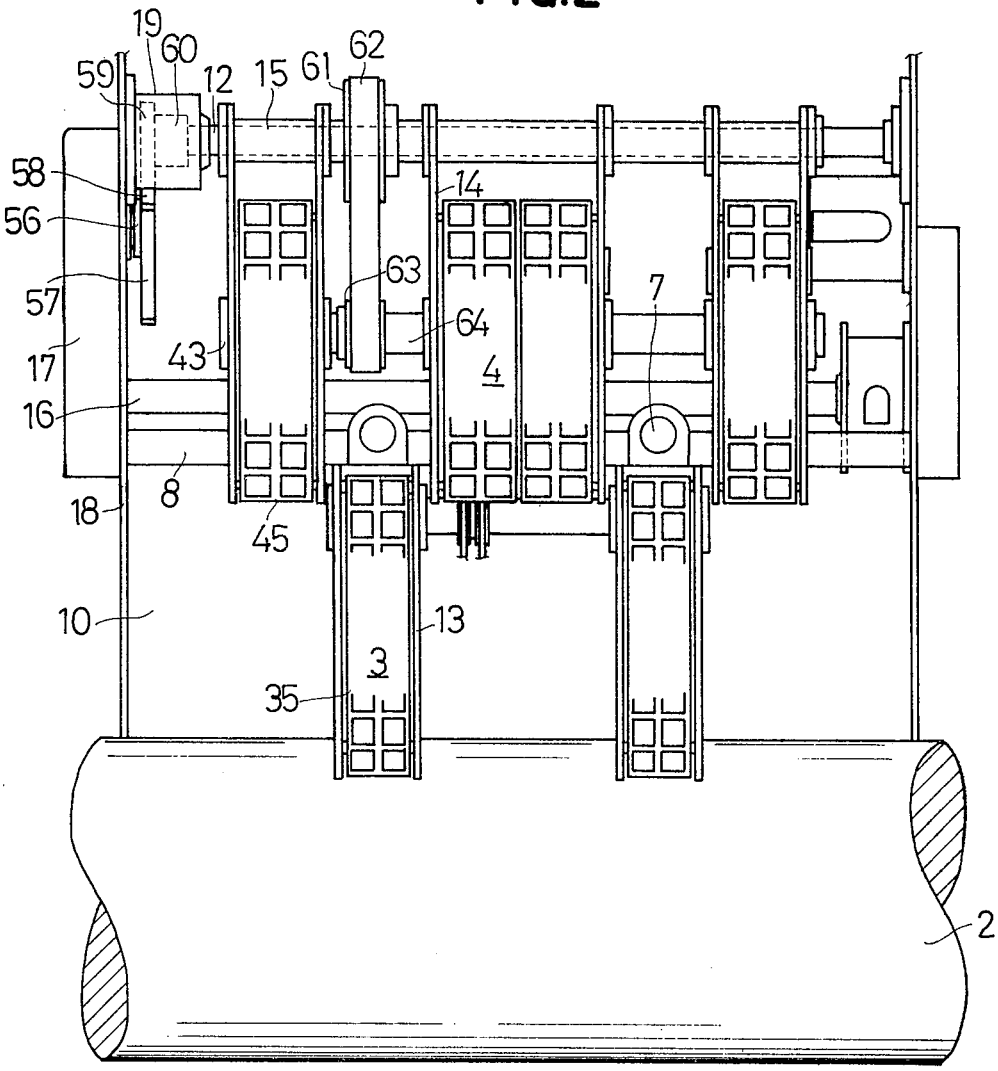
FIG. 2 illustrates portions of the apparatus of FIG. 1 in top plan view, though not to scale.

As is better seen in FIG. 2, the jacks 7 are mounted on a transverse bar 8 which is an element of the stationary support structure 10 of the feeding apparatus. The apparatus is energized by a main drive pulley 11 (FIG. 1) which is mounted on the non-illustrated output shaft of the electric motor driving the cylinders 1, 2 at constant speed or may be synchronized with the rotary cutting machine in any other conventional manner. A timing belt 9 trained over the pulley 11 drives the conveyor systems 3, 4 as will become apparent hereinafter.

The primary conveyor system 4 is pivotally mounted on a shaft 12 mounted between the upright side plates 18 of the support structure as is best seen in FIG. 2. Six parallel carrier plates 14 fixedly fastened to tubes 15 coaxially rotatable on the shaft 12 carry four sets of pulleys 41, 42, 43, 44. As is shown in FIG. 1, a perforated belt 40 is trained over the pulleys of each set. In the illustrated position of the carrier plates 14, a portion 45 of each belt 40 is flush with the tops of the jacks 7 and engages the lowermost sheet 5 in the stack behind the gate 6. Each belt portion 45 is backed by the perforated top of a suction box 46 fixed between two carrier plates 14. A hose 48 connects the box 46 to a vacuum pump, as will presently be described.

The pulleys 41, 42, 44 are idlers. The several pulleys 43 are fixedly mounted on a common shaft 64 journaled in the carrier plates 14 and also provided with a pulley 63. A belt 62 connects the pulley 63 with a pulley 61 on the shaft 12, as is shown more clearly in FIG. 2. The shaft 12 is the output shaft of an overriding or one-way clutch 60 in a housing 19 on one of the side plates 18. The input shaft of the clutch 60 carries a spur gear 59. An idler gear 58 meshes with the gear 59 and a gear 57 on an intermediate shaft 56, as is evident from FIG. 2. The shaft 56 is journaled in a transmission housing 17 fixedly mounted on one of the side plates 18 which also support a countershaft 16. The afore-mentioned belt 9 continuously rotates a pulley 50 fixed on the shaft 16.

A crank arm 53 on the countershaft 16 is connected to the intermediate shaft 56 by a connecting rod 54 and a radial arm 55 on the shaft 56. The shaft 56 thus moves angularly forth and back during each revolution of the countershaft 16, and its stroke may be adjusted by shifting the pivot connection between the connecting rod 54 and the crank arm 53 along the latter in a conventional manner. A cam follower 52 on one of the carrier plates 14, shown in FIG. 1 in broken outline only, cooperates with a radial cam 51 on the shaft 16 to pivot many elements of the primary conveyor system 4 about the axis of the shaft 12 during each revolution of the shaft 16 so that each pulley 41 moves between the fully drawn operative position and the retracted position shown in chain-dotted line, other associated elements of the conveyor system 4, particularly the belt portions 45, moving with the pulleys 41, as only partly indicated in FIG. 1.

The secondary conveyor system 3 has two conveyor belts 30 mounted on respective sets of four pulleys, only the three pulleys 31, 33, 34 of one set being visible in FIG. 1, the fourth pulley being obscured by one of the carrier plates 14. The pulleys of the conveyor system 3 are mounted between carrier plates 13 fixedly fastened to the bar 8 which also support a suction box 36 under a horizontal portion 35 of the belt 30. The suction box 36 is connected to a vacuum pump by a hose 38 as will presently be described. The two pulleys 33 are fixedly mounted on a common shaft 20, and the drive belt 9 is trained in a full turn over a pulley 47 on the shaft 20.

As is shown in a conventional manner in FIG. 3, the hoses 38, 48 connect the suction boxes 36, 46 to respective centrifugal suction pumps 22, 23 which are driven continuously in a conventional manner, not shown. Rotary shut-off valves 24, 25 in the hoses 38, 48 permit each suction box to be connected selectively to the associated pump, each valve 24, 25 being operated by a radial cam 26, 27 on the countershaft 16 and a cam follower 28, 29.

The several cams on the countershaft 16 and the motion transmitting train including the crank arm 53 on the shaft 16 are set to operate the conveyor system 3 in the manner illustrated in FIG. 4. The portion 45 of the primary conveyor belt 40 is in its operative position during an approximate 90° turn of the countershaft 16, as indicated by an arc A. As soon as the belt portion 45 reaches the operative position of simultaneous engagement with the lowermost sheet 5 and the suction box 46, the valve 25 connects the suction box 46 to the pump 23, as indicated by an arc D, and the sheet is secured thereby to the still stationary belt portion. Shortly thereafter, the belt 40 starts moving slowly as the direction of rotation of the pulley 61 is reversed so that its movement may be transmitted to the shaft 12 and thereby to the pulley 43 by the clutch 60, as indicated by the arc B.

When the speed of the belt 40 reaches its maximum value at the approximate mid-point of the arc B, the arcs A, D end. The primary belt portion 45 is retracted together with the suction box 36 which is vented thereby to the atmosphere. The sheet 5 is released from the belt 40 while it partly extends beyond the gap in the gate 6. While the retracted belt 40 gradually slows to a halt, the valve 24 connects the suction box 46 to the pump 22 for more than one half revolution of the countershaft 16, as indicated by the arc C, so that the sheet 5 is secured to the continuously moving belt 35 and fed to the nip of the cylinders 1, 2.

The transmission ratio between the pulleys 33, 34 is chosen so that the maximum speed that the belt 40 can reach is approximately equal to the constant speed of the belt 30. Each sheet 5 is thus attached to the belt 40 while both the sheet and the belt stand still, and the sheet is not subjected to frictional forces by the belt. The friction between superimposed sheets 5 in the stack behind the gate 6 is relatively insignificant. The sheet is transferred from the belt 40 to the belt 30 when both belts travel at practically the same speed, and no mechanical stresses are exerted on the sheet. The two sets of horizontal belt portions 35, 45 overlap each other slightly in the direction of sheet movement in the gap under the gate 6 and are transversely offset as is best seen in FIG. 2 so that the several belt portions may be located in a common horizontal plane when the conveyor system 4 is in its operative position, an arrangement that has been found to permit fairly pliable and mechanically weak sheets to be fed by the apparatus of the invention without difficulty.

The suction boxes 46, 36 are closely adjacent opposite sides of the gate 6, and the suction box 36 is relatively far from the nip of the cylinders 1, 2. Better feeding of relatively short sheets is achieved by a modified apparatus which is illustrated in FIG. 5 only to the extent that it differs from the apparatus described above with reference to FIGS. 1–4.

The third suction box 37 is arranged under the belt 30 between the suction box 36 and the cylinders 1, 2 not themselves shown in FIG. 5. A sheet held to the primary belt 40 by a vacuum in the suction box 46 can reach a position above the suction box 36, and the latter must remain at atmospheric pressure until the suction in the box 46 is shut off. However, a sheet cannot simultaneously be located within range of the suction boxes 46 and 37, and the latter may therefore be connected permanently to a rotary vacuum pump 21 by a hose 39.

The jacks 7 not only support the stack of sheets 5 when the belt 40 is retracted, they also permit operation of the feeding apparatus to be interrupted quickly without shutting off the conveyor drives in the event of difficulties in the rotary die cutter. Air admitted to the jacks causes the entire stack to be lifted above the gap between the lower edge of the gate 6 and the belt portions 45, 35 in the operative position of the belt portion 45.

As has been shown in detail in my earlier patent, the gap bounded by the gate 6 is adjustable for passing individual sheets of different thickness, but it may also be set for passing more than one thickness of sheet material if so desired.

It is generally desirable that the minimum speed of the belt 40 during each cycle of operation be zero, that is, that the belt be decelerated to a complete halt as is inherent in the illustrated motion transmitting train which connects the intermediate shaft 56 to the countershaft 16. However, other linkages may be substituted for the illustrated crank drive and one-way clutch to vary the forward speed of the belt 40 between a minimum value greater than zero and a maximum speed approximately equal to the constant speed of the belt 30.

The conveying systems, 4, 3 have four and two individual belts respectively, and it is preferred that at least one of the systems have at least two belts transversely juxtaposed to a longitudinal portion of one belt of the other system for smooth transfer of a sheet between the two systems. However, at least some of the advantages of this invention are available with conveying systems having one belt each.

It should be understood, therefore, that the foregoing disclosure relates only to presently preferred embodiments, and that it is intended to cover all changes and modifications of the examples of the invention herein chosen for the purpose of the disclosure which do not constitute departures from the spirit and scope of the invention set forth in the appended claims.

What is claimed is:

1. A sheet feeding apparatus comprising:

(a) a support;

(b) gate means mounted on said support, said gate means bounding a receptacle space and partly defining a gap, said space being adapted to hold a stack of sheets, and said gap limiting the number of sheets capable of being withdrawn simultaneously from said space in a predetermined direction;

(c) first conveying means for conveying a sheet from said space to said gap in said predetermined direction, said conveying means including (1) a first suction box offset from said receptacle space in a direction transverse to said predetermined direction, (2) a first perforated belt guided in a closed loop on said support, a portion of said first belt being interposed between said receptacle space and said suction box, (3) shifting means for cyclically shifting said portion of said first belt between an operative position of simultaneous engagement with the sheet to be conveyed and said first suction box and a retracted position offset from said operative position in said transverse direction wherein said first belt is substantially cut out of engagement with the stack of sheets, (4) first drive means for cyclically accelerating and decelerating said first belt in said closed loop between a minimum speed when said first belt portion is in said retracted position and a maximum speed when said first belt portion is in said operative position, wherein said first belt portion is moved by said first drive means in said predetermined direction at said minimum speed when said first belt portion is shifted to said operative position from said retracted position by said shifting means and said first belt portion is moved by said first drive means in said predetermined direction at said maximum speed when said first belt portion is shifted to said retracted position from said operative position by said first drive means, (5) first suction means for cyclically drawing air from said suction box when said portion of said first belt is in said operative position until said sheet is conveyed by said portion of said first belt to said gap; and (d) second conveying means for conveying said sheet from said gap in said predetermined direction, said second conveying means including (1) a second suction box;

(2) a second perforated belt guided in a closed loop on said support, a portion of said second belt extending away from said gap in said predetermined direction in engagement with said second suction box, (3) second drive means for driving said second belt continuously at a speed substantially equal to said maximum speed, and (4) second suction means for cyclically drawing air from said second suction box when said portion of said first belt is being shifted from said operative position thereof to said retracted position wherein the sheet is transferred from said first to said second perforated belt when both said first and said second perforated belts travel at substantially equal speeds.

2. Apparatus as set forth in claim 1, further comprising guide means for guiding said portions of said first and second belts in a common plane when said first portion is in the operative position thereof.

3. Apparatus as set forth in claim 2, wherein the guide means for guiding said portion of said first belt include a carrier pivotally mounted on said support, a plurality of pulleys rotatably mounted on said carrier, said first belt being trained over said pulleys, and said shifting means including means for pivoting said carrier on said support.

4. Apparatus as set forth in claim 1, wherein said first drive means include a rotatable drive shaft and motion transmitting means for transmitting cyclically accelerating and decelerating motion to said first belt, said motion transmitting means including an intermediate shaft, crank means operatively interposed between said drive shaft and said intermediate shaft for turning said intermediate shaft alternatively forward and backward in response to continuous rotation of said drive shaft, and one-way clutch means operatively interposed between said intermediate shaft and said first belt.

5. Apparatus as set forth in claim 1, further comprising a third suction box offset from said second suction box in said predetermined direction in engagement with said second belt, and third suction means for continuously drawing air from said third suction box.

6. Apparatus as set forth in claim 1, wherein respective longitudinal parts of said portions of said first and second belts are juxtaposed transversely to said predetermined direction and said transverse direction, said parts bounding said gap.

7. Apparatus as set forth in claim 1, further comprising control means operatively connected to said shifting means, said first drive means, and said first and second suction means for operating said shifting means, said first drive means, and said first and second suction means in timed sequence.

* * * * *